US006189997B1

(12) United States Patent
Kanome et al.

(10) Patent No.: US 6,189,997 B1
(45) Date of Patent: Feb. 20, 2001

(54) UNCAPPING INK JET HEADS

(75) Inventors: Yuji Kanome; Seiji Takahashi, both of Yokohama (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 08/705,291

(22) Filed: Aug. 29, 1996

(30) Foreign Application Priority Data

Aug. 30, 1995 (JP) ..... 7-221811

(51) Int. Cl.[7] ..... B41J 2/165
(52) U.S. Cl. ..... 347/23
(58) Field of Search ..... 347/23, 29, 30

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/10 |
| 4,459,600 | | 7/1984 | Sato et al. | 347/47 |
| 4,463,359 | | 7/1984 | Ayata et al. | 347/56 |
| 4,558,333 | | 12/1985 | Sugitani et al. | 347/56 |
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 4,893,138 | * | 1/1990 | Terasawa et al. | 347/30 |
| 4,967,204 | * | 10/1990 | Terasawa et al. | 347/30 |
| 5,086,305 | * | 2/1992 | Terasawa | 347/30 |
| 5,126,766 | * | 6/1992 | Terasawa et al. | 347/30 |
| 5,138,334 | * | 8/1992 | Rowe et al. | 347/30 |
| 5,153,614 | * | 10/1992 | Yamaguchi et al. | 347/30 |
| 5,257,044 | * | 10/1993 | Carlotta et al. | 347/30 |
| 5,437,444 | * | 8/1995 | Kawakami et al. | 271/22 |

FOREIGN PATENT DOCUMENTS

| | | |
|---|---|---|
| 0 604 938 | 7/1994 | (EP) . |
| 54-56847 | 5/1979 | (JP) . |
| 59-123670 | 7/1984 | (JP) . |
| 59-138461 | 8/1984 | (JP) . |
| 60-71260 | 4/1985 | (JP) . |

* cited by examiner

*Primary Examiner*—N. Le
*Assistant Examiner*—Michael Nghiem
(74) *Attorney, Agent, or Firm*—Fitzpatrick, Cella, Harper & Scinto

(57) ABSTRACT

An ink jet recording apparatus includes a carriage on which is mountable a recording head provided with discharge ports to discharge ink and which is movable to move the head, a movable cap to cover the discharge ports, and a pump to suck ink from the discharge ports through the cap when the cap covers the discharge ports. A controller controls the recording head to wait for a given period of time in a position facing the cap before the carriage is moved to carry the recording head, subsequent to suction by the pump and separation of the cap from the recording head. This arrangement reduces the possibility that a recording material will be stained by ink following a suction of ink by the pump.

8 Claims, 7 Drawing Sheets

UNCAPPING INK JET HEADS

BACKGROUND OF THE INVENTION

1. Field of the Invention

The present invention relates to an ink jet recording apparatus and a method for operating such apparatus. More particularly, the invention relates to an ink jet recording apparatus that performs the recovery operation while in a recording operation, and a method for operating such apparatus.

2. Related Background Art

A recording apparatus, which is provided with the functions of a printer, a copying machine, a facsimile equipment, and the like, or a recording apparatus used as an output device for a complex type electronic equipment including a computer and a word-processor, or for a work station, is structured to record images on a paper sheet, a thin plastic plate, or some other recording material (recording medium) in accordance with image information. These recording apparatuses are divided into an ink jet type, a wire-dot type, a thermic type, a laser beam type, among others, depending on the recording method that each of them adopts for its recording operation.

Generally, in a serial type recording apparatus that scans in the direction substantially perpendicular to the feeding direction of a recording material (sub-scanning direction), a carriage having a recording head mounted on it serving as recording means travels on a recording material after the recording material has been set at a given recording position. In this way, images are recorded on the recording material in the main scanning direction.

Then, when a one-line portion is recorded, a sheet feed (pitch feed) for a given amount is performed. After that, recording is again executed in the main scanning direction to record images on the next line on the recording material, which is now at a standstill.

The operation described above is repeated to perform the entire recording on a recording material.

Of those recording apparatuses, an ink jet type recording apparatus (an ink jet recording apparatus) that records on a recording material by discharging ink from the recording head serving as recording means has the following advantages:

(1) Recording means can be easily formed compactly.

(2) A highly precise images can be recorded at high speeds.

(3) Recording is possible with respect to an ordinary paper sheet without providing any particular treatment for such paper sheet.

(4) Running costs are low.

(5) Being non-impact type, the apparatus makes lesser amount of noises.

(6) Color images can be recorded easily by use of multiple color ink.

Also, it is ease to record at a higher speed by use of the recording apparatus of line type having a line type recording head provided with a plurality of discharge ports arranged in the feeding direction (sub-scanning direction) of a recording material.

Further, with the recording apparatus wherein ink is discharged from the recording head downward almost in the vertical direction, no gravitation causes ink to curve when its flying is initiated. Therefore, it is possible to make the shooting accuracy of ink excellent with respect to a recording material, and to perform printing more precisely.

Of the ink jet recording apparatuses described above, the one having the ink jet type recording means (recording head) that discharges ink by the utilization of thermal energy can be produced easily through semiconductor fabrication processes, such as etching, deposition, sputtering, and so forth. This enables the film formation of electrothermal transducing elements, electrodes, walls of liquid paths, ceiling plate, and others on a base board, hence making it possible to provide a highly densified arrangement of liquid paths (discharge port arrangement), and to implement making recording means more compactly. Also, it becomes easier to provide a fully multiple recording means and assemble it in a higher density by the utilization of the well advanced IC technologies and micro-machining techniques, which facilitates the elongation and surfacing (two-dimensional arrangement) of recording means.

Nevertheless, in an ink jet recording apparatus of the kind, defective discharges (including disabled discharges) may take place in some cases if discharge ports are clogged by paper particles, dust particles, or some other foreign substances adhering to the ink discharge ports of the recording head or if ink is dried in the discharging portion to make it more viscous or cause it to be fixed thereto. Also, when a new ink cartridge or a new head cartridge is used for the first time, the condition of the ink paths from the discharge ports to the ink tank is not exactly regulated at all times. Therefore, in order to prevent the clogging or to keep the ink paths normal, there are provided cleaning means for removing foreign substances adhering to the ink discharge ports (discharge port formation surface) of a recording head or recovering means for normalizing the discharge ports and ink paths of a recording head.

As cleaning means, a mechanism is adopted to wipe off and clean the discharge port formation surface of a recording head mainly by use of a flexible wiper (wiping member). Also, as recovering means, a recovery device is adopted to cover the ink discharge ports of a recording head mainly by means of a cap when recording is at rest, and at the same time, to suck ink from the ink discharge ports by suction means, such as a pump, through the cap, thus normalizing the ink discharge ports and ink paths.

FIG. 4 is a view showing one structural example of an ink jet recording apparatus of serial type in accordance with the related background art.

As shown in FIG. 4, an apparatus exemplified here comprises at least a carrier roller 108, which is connected to a recording sheet carrier motor (not shown) through a gear train and others of a driving force transmission mechanism 109, and which carries a recording sheet 115 serving as a recording material; a sheet exhaust roller 112 connected to the carrier roller 108 through a driving force transmission gear train 113, while being biased to a spur 114 by means of a biasing member (not shown); a pinch roller 110 rotatively supported on a pinch roller holder 111, which is biased to the carrier roller 108 by means of a biasing member (not shown); a recording head 106 integrally formed with an ink tank, the ink discharge ports of which are arranged downward, serving as recording means for recording on the recording sheet 115; a carriage 101 having the recording head 106 mounted thereon; a guide shaft 102 supporting the carriage 101 slidably in the direction orthogonal to the carrying direction of the recording sheet 115, and also, in the direction parallel to the surface of the recording sheet 115 (in the direction indicated by arrows A in FIG. 4); a carriage driving belt 105 to enable the carriage 101 to reciprocate in the straight-line direction; and a carriage driving motor 103 and a pulley 104. Also, the recording head 106 is connected electrically to a control board (not shown) through a flexible board 107.

Further, outside the recording area, there are provided a wiper 120 structured and interlocked with the movement of the carriage 101 to be able to contact with or part from the ink discharge ports of the recording head 106 in order to clean the recording head 106; a pump 119 to execute the recovery operation of the ink discharge ports in order to keep the ink discharge performance of the recording head in normal condition; and a cap 118 conductively connected to a waste ink tank (not shown) through the pump 119.

Now, the description will be given below as to the printing operation of an ink jet recording apparatus structured as described above:

At first, when a recording sheet 115 is inserted into a recording sheet inlet aperture (not shown) formed by guide members 116 and 117, the recording sheet 115 is pinched by the carrier roller 108 and the pinch roller 110. By the rotation of the carrier roller 108, the recording sheet is carried over to the recording position facing the ink discharge ports of the recording head 106.

Then, the carriage driving motor 103 is driven to rotate the carriage driving belt 105. The carriage 101 reciprocates along the guide shaft 102 in the straight-line direction. At the same time, in response to recording signals, ink is discharged from the recording head 106 mounted on the carriage 101, thus recording the contents to be recorded on the recording sheet 115.

When a one-line portion is recorded, the carrier roller again rotates to carry the recording sheet 115 to the next recording position, where the carriage 101 reciprocates to record the next line.

With the repetition of the operation described above, recording is made on the recording sheet 115.

During the operation described above, the cleaning operation is executed to remove foreign substances adhering to the ink discharge ports of the recording head 106, and the recovery operation is performed for the recording head to implement the normalization of the discharge ports and ink paths.

Now, in accordance with this example, the description will be given below as to the cleaning operation and recovery operation of the recording head.

FIG. 5 is a flowchart showing the flow of cleaning and recovery operations for the recording head of the ink jet recording apparatus shown in FIG. 4.

Usually, when recording is not in operation nor any capping and recovering operations are performed for the recording head 106 of an ink jet recording apparatus, the cap 118 is in contact with the ink discharge portions of the recording head 106 in a cap closed condition (step S201).

When the cleaning and recovery operations are needed for the recording head 106, the cap 118 is driven to part from the ink discharge ports of the recording head 106, thus being in a cap open condition (step S202).

Then, the wiper 120 moves to a position where it can abut upon the ink discharge ports of the recording head 16. While the wiper 120 and the ink discharge ports are in a contact state, the carriage 101 reciprocates in a portion within a given range in the main scanning direction in order to clean the ink discharge ports by means of wiping (step S203). Here, it is assumed that the range for the carriage to travel is a minimum dimension required for the wiper 120 to wipe the ink discharge ports.

When the cleaning of the ink discharge ports by means of wiping is finished, the cap 118 is in contact with the ink discharge ports, thus being in a cap closed condition (step S204).

In the cap closed condition, the ink that has become unsuitable for printing, which is retained in the ink discharge ports, are sucked by the pump 119 compulsorily through the cap 118 (step S205).

When the ink suction is completed, the cap 118 is driven to part from the ink discharge ports, thus again being in the cap open condition (step S206).

At the same time that the cap is in the open condition, the carriage 101 moves to a retracted position where the cap 118 is not allowed to face the ink discharge ports (step S207).

After the carriage 101 has moved, the ink sucked from the ink discharge ports and retained in the cap 118 in the step S205 is sucked and exhausted to an waste ink tank (step S208).

After that, by the same operation as in the step S203 the ink discharge ports are again cleaned by means of wiping (step S209).

When the cleaning of the ink discharge ports by means of wiping is finished, the cap 118 abuts upon the ink discharge ports, thus being in the cap closed condition (step S210).

On the other hand, there are various demands on the kinds of recording materials (recording sheets). In recent years, there have been in demand those having perforations or a rolled continuous paper sheet for use of a hanging screen, besides an ordinary recording sheet material. As a result, it has become necessary to perform the recovery operation in a state that a recording sheet is still set at a recording apparatus.

Now, the ink jet recording apparatus described above is structured to compulsorily suck, in the cap closed condition, the ink that has become unsuitable for printing but still remains in the ink discharge ports, and then, in the cap open condition, the carriage moves to the retracted position where the ink discharge ports are not allowed to face the cap in order to suck the ink, which is retained in the cap.

FIG. 6 is a perspective view showing the ink jet recording apparatus represented in FIG. 4, observed in the direction indicated by an arrow D in FIG. 4, immediately after the cap has been open subsequent to the ink suction.

As shown in FIG. 6, the ink 121, which is sucked into the cap 118 from the ink discharge ports 106*a*, is sometimes caused to remain in a state of being connected between the cap 118 and the ink discharge port 106*a* due to the relationship between the allowable capacity of the cap 118 to hold ink and the amount of ink being retained in the cap 118, and the relationship between the distance from cap 118 to the ink discharge ports 106*a* and the viscosity of ink as well.

On the other hand, the retracting position, which the carriage 101 should move to the retracting position, which is arranged on the passage area of the recording sheet 115 so that the main body of the recording apparatus can be made compact. Therefore, when the carriage 101 moves, it should travel on the passage area of the recording sheet 115.

As a result, there is a problem that a recording sheet 115 is stained if the recording sheet 115 is present on the passage area arranged for it, while the carriage 10 moves in such a state that ink 121 is still connected between the cap 118 and the ink discharge port 106*a*, because the ink, which trails from the recording head 106, is liable to drop onto the recording sheet 115.

SUMMARY OF THE INVENTION

The present invention is designed in consideration of the problems described above. It is an object of the invention to provide an ink jet recording apparatus capable of performing the cleaning and recovery operations for the ink discharge ports without staining a recording material, and to provide a method for operating such apparatus.

It is another object of the invention to provide an ink jet recording apparatus comprising:

a carriage to mount on it a recording head provided with discharge ports to discharge ink, and to move the head;

a cap to be in contact with the recording head to cover the discharge ports;

a pump to suck at the discharge ports through the cap when the cap covers the discharge ports; and control means for enabling the recording head to wait for a given period of time in a position for the recording head to face the cap before the carriage begins to carry the recording head subsequent to the suction of the pump and the separation of the recording head and the cap.

It is still another object of the invention to provide a method for operating an ink jet recording apparatus, comprising the following steps of:

sucking at discharge ports through a cap when the cap covers the discharge ports of a recording head;

causing the recording head and the cap to part from each other;

enabling the recording head to wait for a given period of time in a position to face the cap; and moving the recording head by use of a carriage that travels with the recording head being mounted thereon.

In accordance with the present invention, which is structured as described above, a cap is driven to part from the ink discharge ports after ink is sucked from them by use of a pump through the cap in a state that the ink discharged ports are covered by the cap, and the carriage moves to a retracting position where the ink discharge ports are not allowed to face the cap after a waiting time set longer than the period of time required for the ink retained in the cap to be completely separated between the cap and ink discharge ports on the respective sides thereof subsequent to the cap having parted from the ink discharge ports, and then, the ink residing still in the cap will be sucked by use of the pump when the recovery operation is executed for the ink discharge ports in order to keep the ink discharge performance of the recording head in normal condition. As a result, there is no possibility that a recording material is stained by ink when the recovery operation is executed for the recording head.

DETAILED DESCRIPTION OF THE PREFERRED EMBODIMENTS

Hereinafter, with reference to the accompanying drawings, the description will be made of an ink jet recording apparatus in accordance with the embodiments of the present invention.

(First Embodiment)

Figure 1:
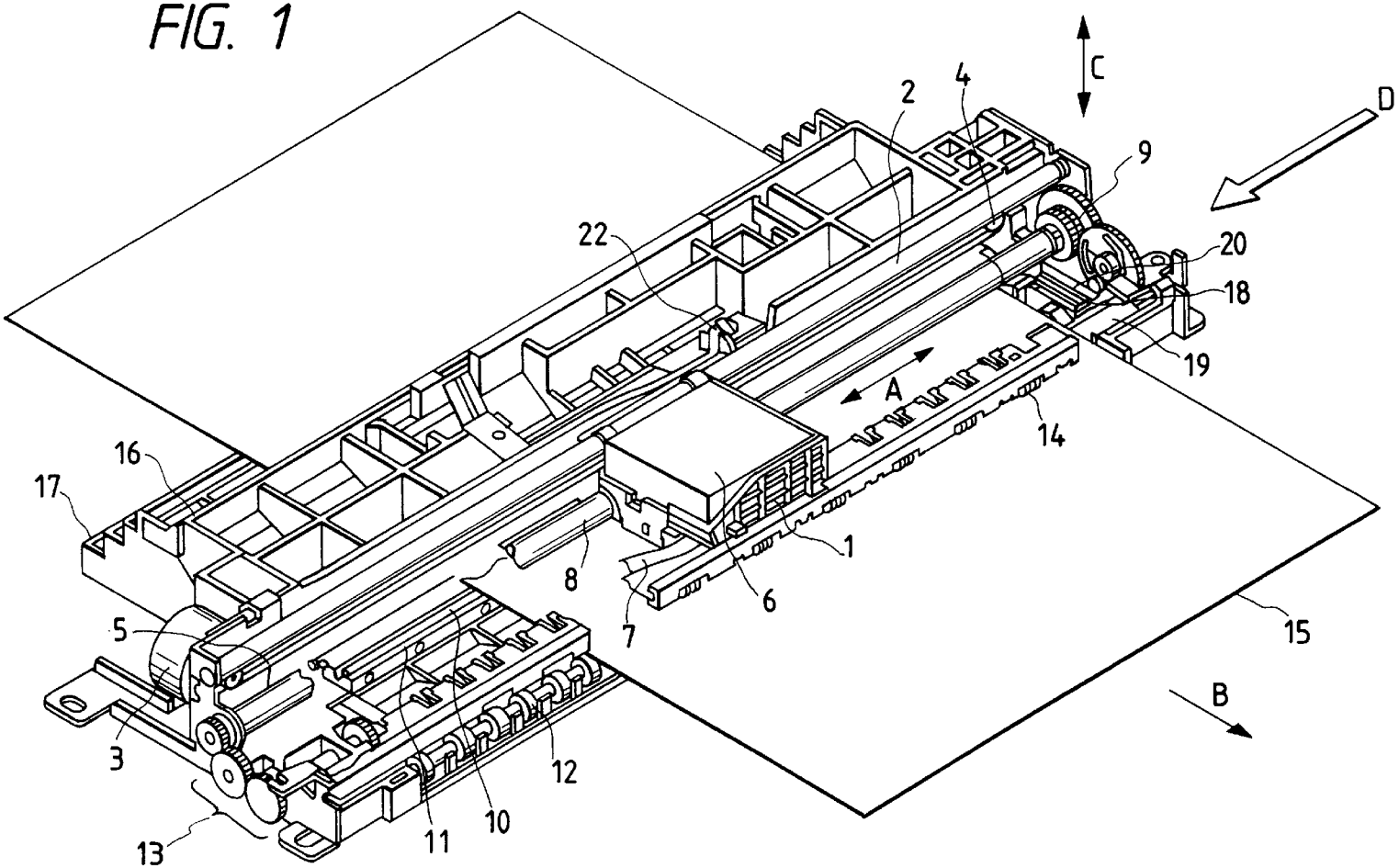
FIG. 1 is a view showing an ink jet recording apparatus in accordance with a first embodiment of the present invention.

FIG. 1 is a view which shows an ink jet recording apparatus in accordance with a first embodiment of the present invention.

As shown in FIG. 1, an ink jet recording apparatus embodying the present invention comprises at least a carrier roller 8, which is connected to a recording sheet carrier motor (not shown) through a gear train and others of a driving force transmission mechanism 9, and which carries a recording sheet 15 serving as a recording material; a sheet exhaust roller 12 connected to the carrier roller 8 through a driving force transmission gear train 13, while being biased to a spur 14 by means of a biasing member (not shown); a pinch roller 10 rotatively supported on a pinch roller holder 11 biased to the carrier roller 8 by means of a biasing member (not shown); a recording head 6 integrally formed with an ink tank having the ink discharge ports being arranged downward, which serves as recording means for recording on the recording sheet 15; a carriage 1 having the recording head 6 mounted thereon; a guide shaft 2 supporting the carriage 1 slidably in the direction orthogonal to the carrying direction of the recording sheet 15, and also, in the direction parallel to the surface of the recording sheet 15 (in the direction indicated by arrows A in FIG. 1); a carriage driving belt 5 to enable the carriage 1 to reciprocate in the straight-line direction; a carriage driving motor 3 and a pulley 4; and a recording sheet sensor 22 to detect whether or not the recording sheet 15 is present on the passage area of the recording sheet. Also, the recording head 6 is connected to a control board (not shown) electrically through a flexible board 7.

Further, outside the recording area, there are provided a wiper 20 structured and interlocked with the movement of the carriage 1 to be able to contact with or part from the ink discharge ports of the recording head 6 for cleaning the recording head 6; a pump 119 for executing the recovery operation of the ink discharge ports in order to keep the ink discharge performance of the recording head in normal condition; and a cap 18 conductively connected to a waste ink tank (not shown) through the pump 19.

Now, the description will be given below as to the cleaning and recovery operations for the recording head in accordance with this mode embodying the present invention.

Figure 2:
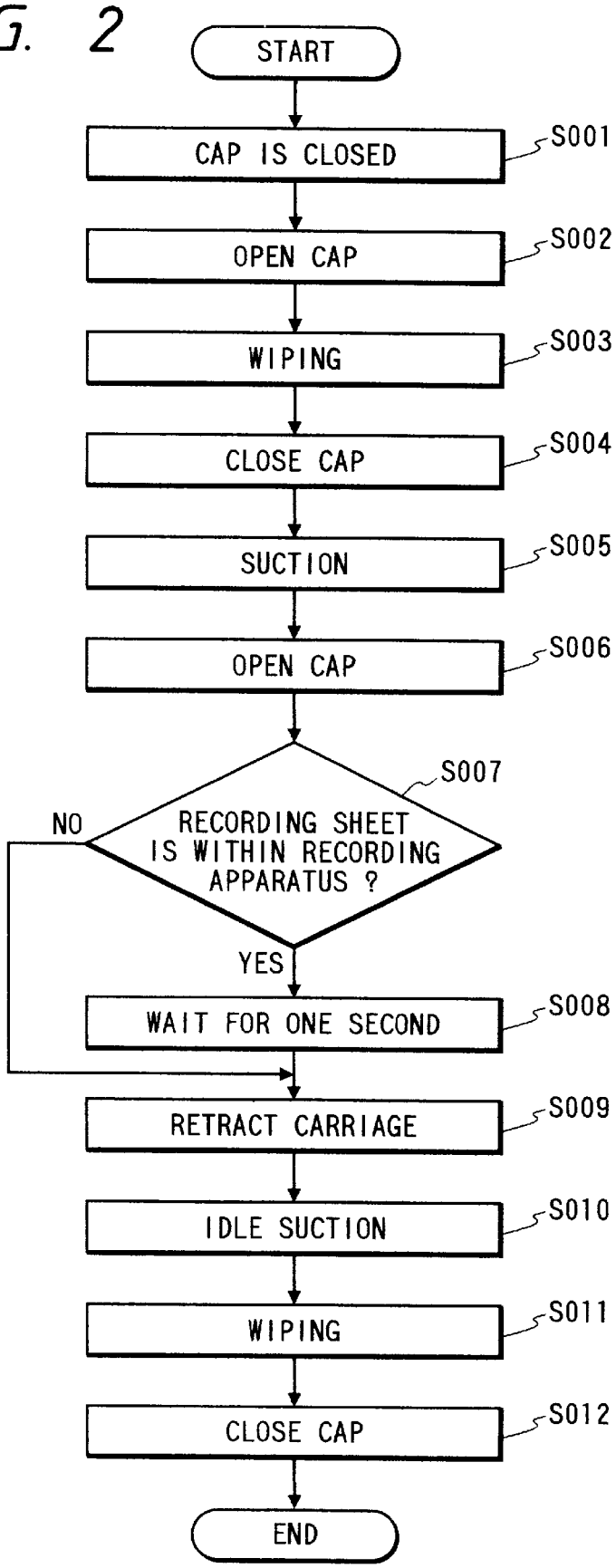
FIG. 2 is a flowchart showing the flow of the cleaning and recovery operations of a recording head for the ink jet recording apparatus represented in FIG. 1.

FIG. 2 is a flowchart which shows the flow of the cleaning and recovery operations for the recording head of the ink jet recording apparatus represented in FIG. 1.

Usually, when recording is not in operation nor any capping and recovering operations are performed for the recording head 6 of an ink jet recording apparatus, the cap 18 is in contact with the ink discharge portions of the recording head 6 in a cap closed condition (step S001).

When the cleaning and recovery operations are needed for the recording head 6, the cap 18 is driven to part from the ink discharge ports of the recording head 6, thus being in a cap open condition (step S002).

Then, the wiper 20 moves to a position where it can abut upon the ink discharge ports of the recording head 6. While the wiper 20 and the ink discharge ports are in contact, the carriage 1 reciprocates in a portion of a given range in the main scanning direction to clean the ink discharge ports by means of wiping (step S003). Here, it is assumed that the range for the carriage to travel is a minimum dimension required for the wiper 20 to wipe the ink discharge ports.

When the cleaning of the ink discharge ports by means of wiping is finished, the cap 18 is caused to abut upon the ink discharge ports, thus being in a cap closed condition (step S004).

In the cap closed condition, the ink that has become unsuitable for printing, which is retained in the ink discharge ports, are sucked by the pump 19 compulsorily through the cap 18 (step S005).

When the ink suction is completed, the cap 18 parts from the ink discharge ports, thus being again in the cap open condition (step S006).

At the same time that the cap is in the open condition, it is determined by the recording sheet sensor 22 whether or not any recording sheet 15 is present on the passage area of the recording sheet (step S007).

In the step S007, if a recording sheet 15 is found to be present, a waiting time of one second is set (step S008).

After the waiting time of one second has elapsed, the carriage 1 moves to the retracting position where the ink discharge ports are not allowed to face the cap 18 (step S009). Here, in the step S007, if no recording sheet 15 is found to be present, the process proceeds from the step S007 to the step S009.

After the movement of the carriage 1, the ink, which is sucked from the ink discharge ports in the step S005 and retained in the cap 18, is sucked and exhausted to the waste ink tank (step S010).

Then, by the same operation as in the step S003, the ink discharge ports are again cleaned by means of wiping (step S011).

When the ink discharge ports have been cleaned by means of wiping, the cap 18 abuts upon the ink discharge ports, thus being in cap closed condition (step S012).

As described above, it is arranged that if a recording sheet 15 is set in the recording apparatus, the carriage 1 moves after a waiting time of one second subsequent to the ink suction. Therefore, the ink connected between the ink discharge ports and the cap 18 are completely separated during such waiting time, and then, the carriage 1 moves in this condition. Thus there is no possibility that ink drops onto a recording sheet 15 to stain it when the carriage 1 moves.

Also, if no recording sheet 15 is set in the recording apparatus, there is no fear that even if ink drops from the recording head 6, it stains any recording sheet 15. It is unnecessary to set any waiting time in this respect. Hence, the carriage 1 is allowed to move immediately after the cap is open in order to make the time required for recovery operation shorter.

In accordance with this mode embodying the present invention, the material of the cap 18 is chlorinated butyl rubber and the allowable ink capacity thereof is 0.14 ml. The cap thus formed is used in condition that the amount of ink suction is 0.12 ml at the time of suction; the distance between the cap and ink discharge ports is 1.3 mm when the cap is in the open condition; the ink viscosity is 1.8 cp (at 25° C.); and the surface tension is 46 dyn/cm (at 25° C.). The ink discharge port surface of the recording head 6 is formed by polysulfone (PSF). With this arrangement, the cleaning and recovery operations are executed for the recording head 6. Then, it is confirmed that if the minimal waiting time is set at one second after the cap is open, the ink connected between the ink discharge ports and the cap 18 is completely cut off.

In this respect, the period of time required for the ink connected between the ink discharge ports and the cap 18 to be completely cut off varies depending on conditions of the material and allowable ink capacity of the cap 18, the amount of ink sucked at the time of suction, the distance between the cap 18 and the ink discharge ports when the cap is open, the viscosity and surface tension of ink, and the material of the ink discharge ports of the recording head 6, among others. Therefore, the waiting time before the movement of the carriage after the cap is open is not necessarily limited to one second. It should be good enough if only a waiting time is set longer than the period of a time required for the complete separation of ink depending on the constituents of each recording apparatus.

(Other Embodiments)

Figure 3:
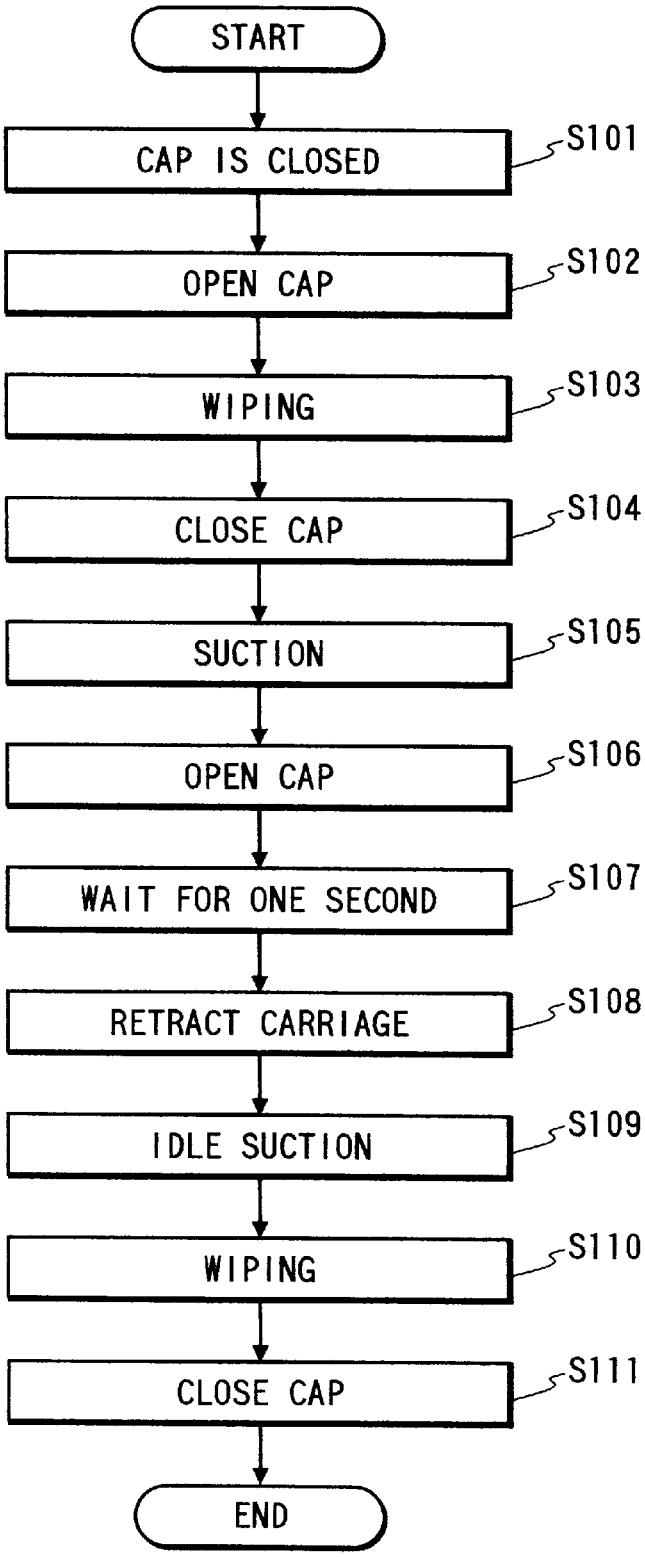
FIG. 3 is a flowchart showing the flow of the cleaning and recovery operations of the recording head of an ink jet recording apparatus in accordance with another embodiment of the present invention.
Figure 4:
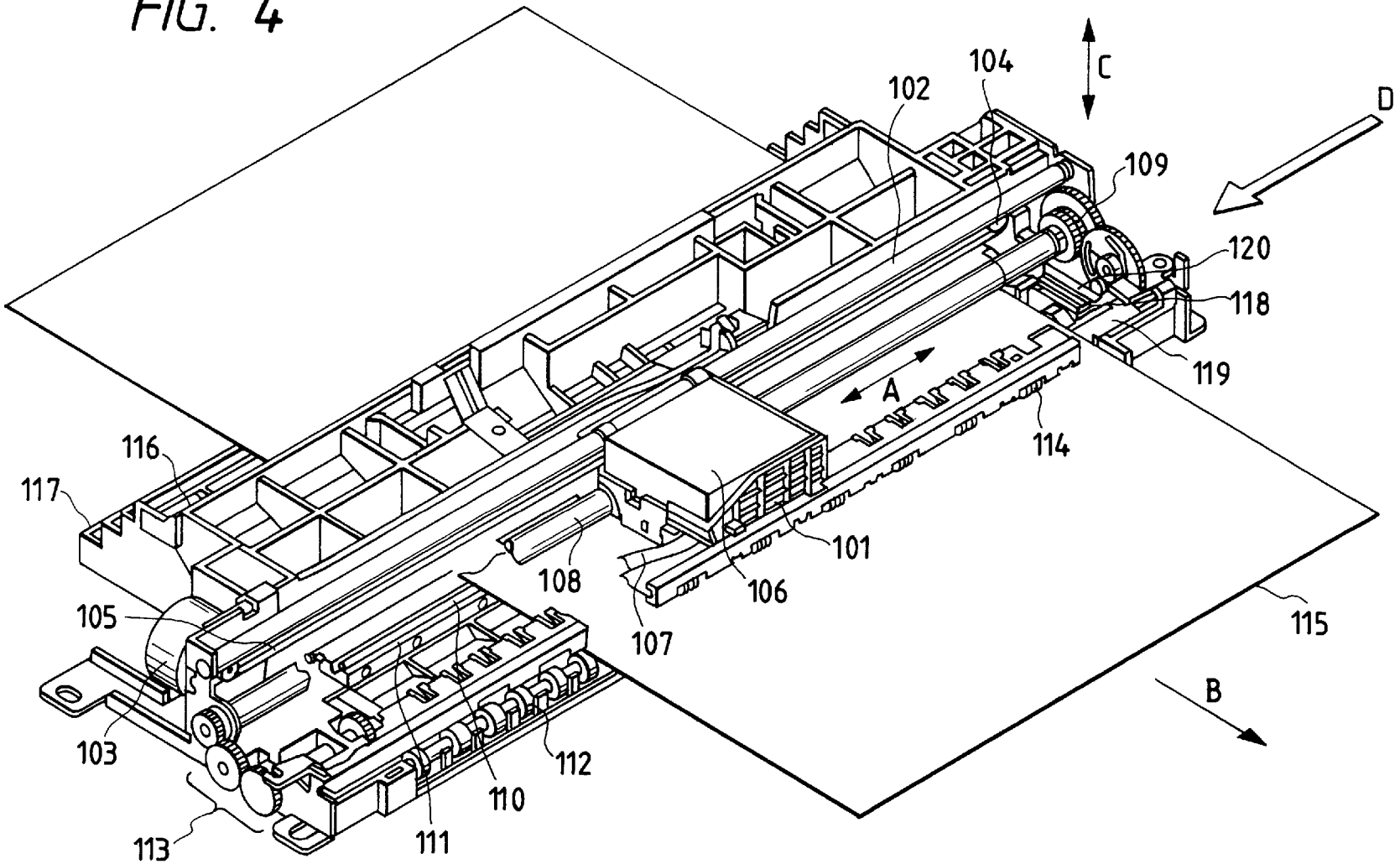
FIG. 4 is a view showing one structural example of a serial type ink jet recording apparatus in accordance with the related background art.
Figure 5:
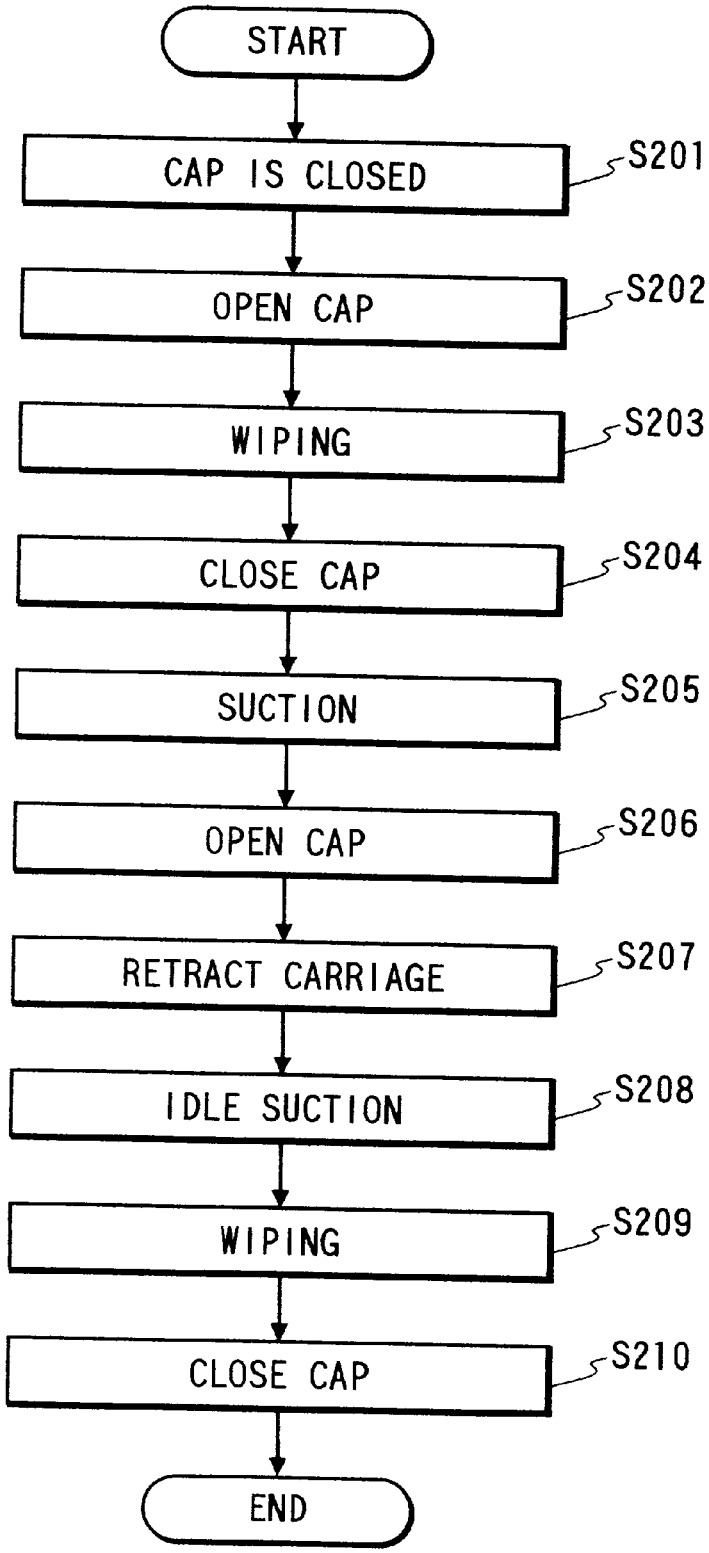
FIG. 5 is a flowchart showing the flow of the cleaning and recovery operations of the recording head of the ink jet recording apparatus represented in FIG. 4.
Figure 6:
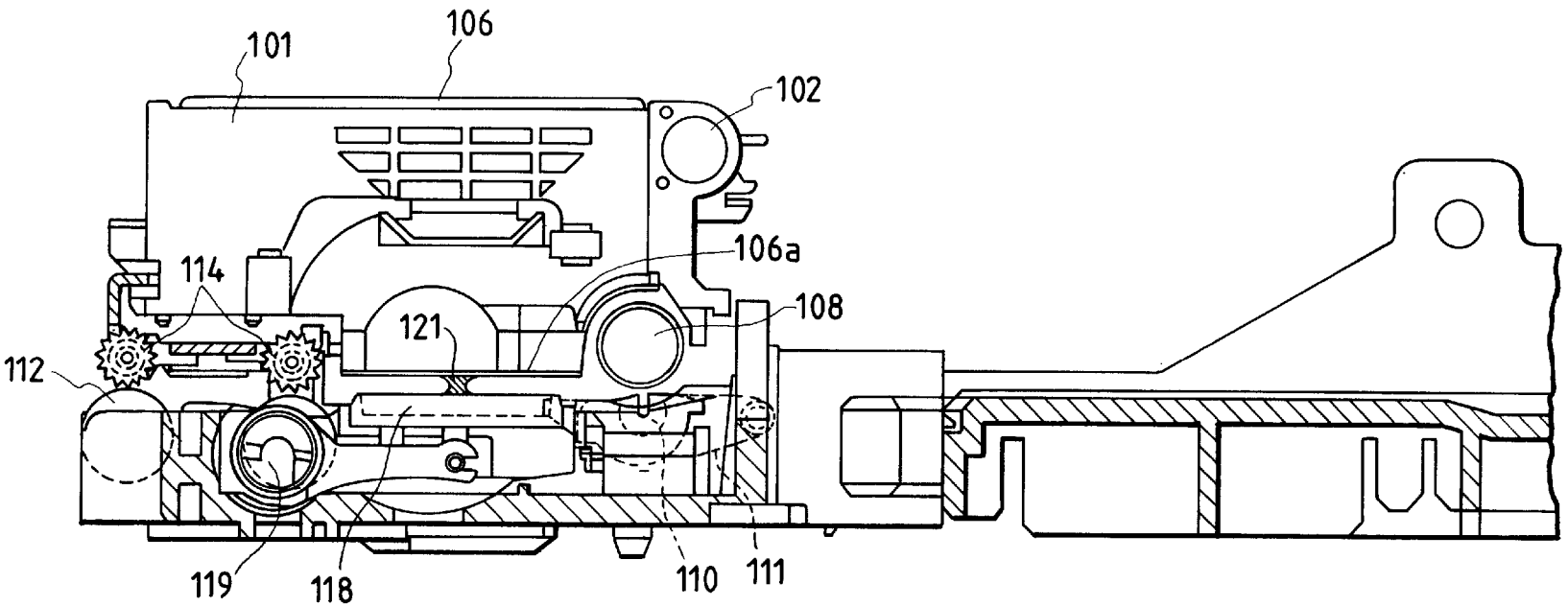
FIG. 6 is a perspective view of the ink jet recording apparatus represented in FIG. 4, observed in the direction indicated by an arrow D in FIG. 4 immediately after the cap is open subsequent to the execution of ink suction.

FIG. 3 is a flowchart showing the flow of cleaning and recovery operations for the recording head of an ink jet recording apparatus in accordance with another embodiment of the present invention.

As shown in FIG. 3, this mode embodying the present invention is such that a waiting time of one second is set at all times without taking any steps of determining whether or not a recording sheet 15 is present on the passage area of the recording sheet subsequent to the performance of suction and cap opening, thus making it possible to prevent a recording sheet 15 from being stained.

For this mode of embodiment, too, the waiting time is not necessarily limited to one second as referred to in the first embodiment.

Here, although the present invention has been described in accordance with the above embodiments whereby to adopt a printer provided with a carriage having an ink jet recording head mounted thereon, it may also be possible to apply the invention suitably to an information processing apparatus capable of reading image information from a source document supported by means of a platen by arranging a scanner unit to be mounted on a carriage exchangeably with an ink jet recording head. Here, the scanner unit is formed substantially in the same exterior as that of an ink jet recording head to be used.

Figure 7:
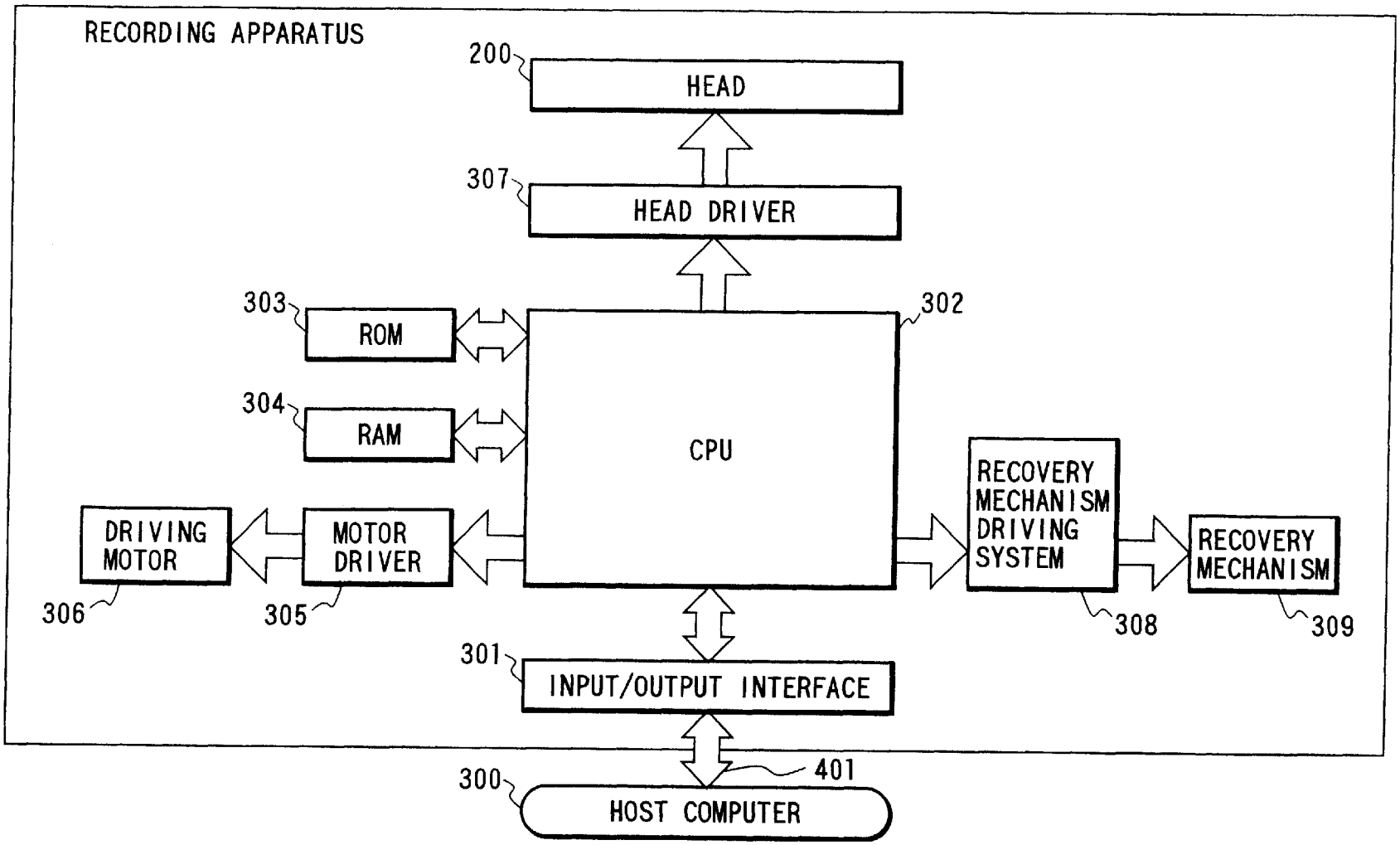
FIG. 7 is a block diagram showing an ink jet recording apparatus in accordance with the present invention.

FIG. 7 is a block diagram showing a system as a whole to operate a liquid discharge apparatus to which the present invention is applicable.

A recording apparatus receives printing information from a host computer 300 as control signals. The printing information is temporarily stored in an input interface 301 of a printing apparatus, and at the same time, converted into processible data in it, thus being inputted into a CPU 302 dually serving as means for supplying head driving signals. The CPU 302 processes the data inputted into it by means of a RAM 304 and other peripheral units in accordance with a control program stored in a ROM 303, and converts such data into printing data (image data).

Also, the CPU 302 produces driving data in accordance with the image data to drive a driving motor in order to move a recording sheet and a recording head in synchronism for recording image data on appropriate positions on the recording sheet. The image data and motor driving data are transferred to the head 200 and the driving motor 306 through a head driver 307 and a motor driver 305, respectively, for the formation of images in accordance with each controlled timing accordingly. Further, the CPU 302 operates a recovery mechanism 309 by driving the recovery mechanism driving system 308, and also, by driving the motor driver 305, the CPU executes the recovery operation as arranged in accordance with the present invention.

As a recording medium adaptable for a recording apparatus described above, for which the provision of liquid such as ink is possible, there are various kinds of paper sheets, OHP sheets, plastic materials to be used for a compact disk, ornamental board, or the like, cloths, aluminum, copper, or other metallic materials, leather materials such as cattle hides, pig hides, and artificial leathers, lumber materials such as woods, and plywood, bamboo materials, tiles and other ceramic materials, and also, a three-dimensional material such as sponge, and so forth.

Also, as the recording apparatuses described above, there are included a printing apparatus for recording on various kinds of paper sheets, OHP sheets, or the like, a recording apparatus for use of plastic materials such as compact disks and others, a recording apparatus for use of metallic materials such as a metal plate, a recording apparatus for use of leather materials to record images on them, a recording apparatus for use of lumber materials to record images on them, a recording apparatus for use of ceramic materials to record images on them, a recording apparatus for recording images on three-dimensional network structures such as sponge and so forth, and also, a textile printing apparatus for recording images on fabrics.

Also, as discharging liquid to be used for these liquid jet apparatuses, a liquid usable for each of the recording media may be adoptable under each of the agreeable recording conditions.

Of the ink jet recording apparatuses, the present invention demonstrates particularly excellent effects when it is applied to a recording head and recording apparatus using a method whereby to create flying droplets by the application of thermal energy for the performance of recording.

Regarding the typical structure and operational principle of such method, it is preferable to adopt those which can be implemented using the fundamental principle disclosed in the specifications of U.S. Pat. Nos. 4,723,129 and 4,740,796, for example. This method is applicable to the so-called on-demand type recording system and a continuous type recording system as well. Particularly, however, the method is suitable for the on-demand type because the principle is such that at least one driving signal, which provides a rapid temperature rise beyond a departure from nucleation boiling point in response to recording information, is applicable to an electrothermal transducing element disposed on a liquid (ink) retaining sheet or liquid passage whereby to cause the electrothermal transducing element to generate thermal energy to produce film boiling on the thermoactive portion of recording means (recording head), thus effectively leading to the resultant formation of a bubble in the recording liquid (ink) one to one in response to each of the driving signals. By the development and contraction of the bubble, the liquid (ink) is discharged through a discharge port to produce at least one droplet. The driving signal is more preferably in the form of pulses because the development and contraction of the bubble can be effectuated instantaneously, and, therefore, the liquid (ink) is discharged with quicker response.

The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducing elements (linear type liquid passages or right-angled liquid passages). Besides, the structure such as disclosed in the specifications of U.S. Pat. Nos. 4,558,333 and 4,459,600 wherein the thermal activation portions are arranged in a curved area is also included in the present invention.

In addition, the present invention is effectively applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an aperture for absorbing pressure wave of the thermal energy is formed corresponding to the discharge ports.

Further, the present invention is effectively applicable to a recording head of full-line type having a length corresponding to the maximum width of a recording medium recordable by the recording apparatus. For such recording head, it may be possible to adopt either a structure whereby to satisfy the required length by combining a plurality of recording heads or a structure arranged by one recording head integrally formed.

In addition, the present invention is effectively applicable to the recording head of an exchangeable chip type, which can be electrically connected with the apparatus main body or to which ink can be supplied from the apparatus main body when it is installed in the apparatus main body, or using the recording head of a cartridge type in which an ink tank is formed integrally with the recording head itself.

Also, for the present invention, it is preferable to additionally provide a recording head with recovery means and preliminarily auxiliary means as constituents of the recording apparatus because these additional means will contribute to making the effectiveness of the present invention more stabilized. To name them specifically, these are capping means, cleaning means, wiping member, suction or compression means, preheating means such as electrothermal transducing elements or heating elements other than such transducing elements or the combination of those types of elements, and a predischarge means of a recording head for performing discharges other than the regular discharges.

Furthermore, the present invention is extremely effective in applying it not only to a recording mode in which only main color such as black is used, but also to an apparatus having at least one of multi-color modes with ink of different colors, or a full-color mode using the mixture of the colors, irrespective of whether the recording heads are integrally structured or it is structured by a combination of plural recording heads.

In the embodiments of the present invention described above, while the ink has been described as liquid, it may be an ink material which is solidified below the room temperature but liquefied at the room temperature. Since the ink is generally controlled within the temperature not lower than 30° C. and not higher than 70° C. to stabilize its viscosity for the provision of the stable discharge, the ink may be such as to be liquefied when the applicable recording signals are given.

In addition, while positively preventing the temperature from rising due to the thermal energy by use of such energy as an energy to be consumed for changing states of ink from solid to liquid, or by use of the ink which will be solidified when left intact for the purpose of preventing the ink from being evaporated, it may be possible to adopt for the present invention the use of an ink having a nature of being liquefied only by the application of thermal energy, such as an ink capable of being discharged as ink liquid by enabling itself to be liquefied anyway when the thermal energy is given in accordance with recording signals, and an ink which will have already begun solidifying itself by the time it reaches a recording medium. In such a case, it may be possible to retain ink in the form of liquid or solid in the recesses or through holes of a porous sheet such as disclosed in Japanese Patent Laid-Open Application No. 54-56847 or 60-71260 in order to enable the ink to face the electrothermal transducers. In the present invention, the most effective method for the various kinds of ink mentioned above is the one capable of implementing the film boiling method as described above.

Moreover, as the mode of the recording apparatus in accordance with the present invention, it may be possible to adopt a copying apparatus combined with a reader, in addition to the image output terminal for a computer or other information processing apparatus, and also, it may be possible to adopt a mode of a facsimile equipment having transmitting and receiving functions.

Since the present invention is structured as described above, it is possible to obtain the following effects:

A waiting time is set longer than the period of time required for ink retained in the cap to be completely separated on the cap side and the ink discharge port side between them after the cap is open and before the movement of the carriage begins. Therefore, when the carriage moves, there is no possibility that ink drops onto a recording material. As a result, it is possible to perform cleaning and recovery operations for the ink discharge ports without causing any stains on a recording material.

With the provision of a recording sheet sensor to detect whether or not a recording material is present on the passage area of the recording material, it is arranged to set a waiting time only when a recording material is found to be present on the passage area. As a result, the period of time required for the completion of a recovery operation can be made shorter when no recording material is present on its passage area.

Since the recording head is provided with electrothermal transducing elements to generate thermal energy for use of ink discharge, it is possible to attain ink discharges having excellent responses in particular.

The recording head has a function to discharge ink from the discharge ports by the utilization of film boiling created in ink by the application of thermal energy generated by electrothermal transducing elements. Therefore, it can demonstrate the same effect referred to in the preceding paragraph.

What is claimed is:

1. An ink jet recording apparatus comprising:

a carriage on which is mountable a recording head provided with discharge ports to discharge ink, and which is movable to move said recording head;

a cap, wherein said cap and said recording head are relatively movable between at least a separation position in which said cap and said recording head are separated from each other and a covering position in which said cap covers said discharge ports;

a pump to suck ink from said discharge ports through said cap when said cap covers said discharge ports; and control means for controlling said recording head to wait for a given period of time in a position at which said recording head faces said cap subsequent to suction of ink from the discharge ports through the cap by said pump in the covering position, subsequent to separation of said cap, and said recording head in the separation position and before subsequent movement of said carriage;

wherein after said control means controls said recording head to wait for the given period of time, said carriage moves said recording head to a non-facing position where said recording head does not face said cap, and ink retained in said cap is sucked by said pump.

2. An ink jet recording apparatus according to claim 1, wherein said non-facing position is above a passage area of a recording material to be recorded on by said recording head.

3. An ink jet recording apparatus according to claim 1, further comprising a recording sheet sensor for detecting whether or not a recording material is present on a passage area of said recording material, and said given period of time is set only when the presence of said recording material is detected.

4. An ink jet recording apparatus according to claim 1, wherein said given period of time is longer than a period of time required for ink retained in said cap to be completely separated from said discharge ports after said cap and said recording head are separated.

5. An ink jet recording apparatus according to claim 4, wherein said given period of time is one second or more.

6. An ink jet recording apparatus according to claim 1, wherein said recording head is provided with electrothermal transducing elements to generate thermal energy to be utilized for discharging ink.

7. An ink jet recording apparatus according to claim 6, wherein said recording head discharges in k from said discharge ports by utilization of film boiling created in ink by thermal energy applied by said electrothermal transducing elements.

8. A method for operating an ink jet recording apparatus, comprising the following steps of:

relatively moving a cap and a recording head to a covering position in which the cap covers ink discharge ports of the recording head;

sucking ink from the discharge ports through the cap while in the covering position;

relatively moving the cap and the recording head to a separation position in which the recording head and the cap are separated from each other;

controlling said recording head to wait for a given period of time in the separation position at a position to face the cap before subsequent movement of said recording head;

moving the recording head to a non-facing position at which said recording head does not face said cap, wherein said step of moving occurs only after the given period of time; and sucking ink retained in said cap after said step of moving.

* * * * *

UNITED STATES PATENT AND TRADEMARK OFFICE

CERTIFICATE OF CORRECTION

PATENT NO. : 6,189,997 B1
DATED : February 20, 2001
INVENTOR(S) : Yuji Kanome et al.

It is certified that error appears in the above-identified patent and that said Letters Patent is hereby corrected as shown below:

Column 1,
Line 46, "A highly" should read -- Highly --.
Line 54, "noises." should read -- noise. --.
Line 57, "ease" should read -- easy --.

Column 4,
Line 1, "are" should read -- is --.

Column 7,
Line 9, "are" should read -- is --.

Column 10,
Line 39, "it" should be deleted.
Line 44, "it is" should read -- they are --.

Column 12,
Line 33, "in k" should read -- ink --.

Signed and Sealed this

Sixteenth Day of April, 2002

*Attest:*

*Attesting Officer*

JAMES E. ROGAN
*Director of the United States Patent and Trademark Office*